US005878887A

United States Patent [19]

Parker et al.

[11] Patent Number: 5,878,887

[45] Date of Patent: Mar. 9, 1999

[54] CHILD-RESISTANT BLISTER PACKAGE

[75] Inventors: Kathleen Alek Parker, Glenmoore, Pa.; Russel Haines, Sr., Brielle, N.J.

[73] Assignee: The West Company, Incorporated, Lionville, Pa.

[21] Appl. No.: 895,166

[22] Filed: Jul. 16, 1997

[51] Int. Cl.[6] ..... B65D 83/04; B65D 73/00; B65D 43/20

[52] U.S. Cl. ..... 206/528; 206/531; 206/468; 206/538; 220/350; 220/345

[58] Field of Search ..... 206/531, 538, 206/539, 532, 534, 461, 468; 220/345, 346, 347, 350, 351

[56] References Cited

U.S. PATENT DOCUMENTS

| | | | |
|---|---|---|---|
| 206,498 | 5/1878 | Nicolle | 206/532 |
| 3,504,788 | 4/1970 | Gray . | |
| 3,603,453 | 9/1971 | Serrell et al. . | |
| 3,610,410 | 10/1971 | Seeley . | |
| 3,812,963 | 5/1974 | Zahuranec et al. | 206/468 |
| 3,912,081 | 10/1975 | Haines et al. . | |
| 3,921,804 | 11/1975 | Tester | 206/531 |
| 4,125,190 | 11/1978 | Davie, Jr. et al. | 206/532 |
| 4,437,566 | 3/1984 | Szahler | 206/468 |
| 5,150,793 | 9/1992 | Tannenbaum . | |
| 5,172,812 | 12/1992 | Wharton et al. . | |
| 5,244,091 | 9/1993 | Tannenbaum . | |
| 5,251,757 | 10/1993 | Relyea et al. . | |
| 5,265,728 | 11/1993 | Allendorf et al. . | |
| 5,275,291 | 1/1994 | Sledge . | |
| 5,339,960 | 8/1994 | Price . | |
| 5,346,069 | 9/1994 | Intini . | |
| 5,377,839 | 1/1995 | Relyea et al. . | |
| 5,489,025 | 2/1996 | Romick . | |

*Primary Examiner*—Paul T. Sewell
*Assistant Examiner*—Jila Mohandesi
*Attorney, Agent, or Firm*—Panitch Schwarze Jacobs & Nadel, P.C.

[57] ABSTRACT

A child-resistant blister package having a tray adapted to receive a blister card with at least one blister compartment is provided. The tray includes a first slide component. A cover having a top and a second slide component is provided. The second slide component is complementary to and slidingly engaged with the first slide component. The second slide component is connected to the top of the cover such that the cover can be slidably displaced relative to the tray between a first position, in which the top of the cover substantially overlies the tray and is adapted to prevent access to the blister card, and a second position, in which the cover is displaced at least partially from the tray such that the blister card is exposed. A tab is connected to the cover, and one of a locking projection and a slot is located on the tab. The other of the slot and the locking projection is located on a first portion of the tray in a complementary location to the locking projection when the cover is in the first position, such that the locking projection is engaged in the slot to limit relative movement of the cover with respect to the tray. One of the tab and the first portion of the tray is movable to a position in which the locking projection is disengaged from the slot to permit movement of the cover to the second position.

18 Claims, 6 Drawing Sheets

CHILD-RESISTANT BLISTER PACKAGE

BACKGROUND OF THE INVENTION

The present invention relates to a child-resistant package of the type adapted to receive a blister card, and more particularly, to a child-resistant package which is also easy for adults with limited dexterity to open.

There is a continuing problem in the pharmaceutical industry of providing containers which are both child resistant as well as openable by adults having limited dexterity. Each year, numerous children are injured by the ingestion of pills, tablets and capsules of pharmaceutical products which are not packaged sufficiently to prevent opening by a child.

Many pharmaceutical products, such as pills, tablets, capsules, syringes and other articles, are packaged in blister packs which inhibit contamination and product tampering while providing easy access. Typically, one or more articles are sandwiched between a layer of transparent, translucent, opaque or colored plastic in the form of an outwardly extending cavity or blister, and a second, rupturable or puncturable layer. Force applied to the blister in the plastic layer is transmitted to the article, which ruptures or punctures the puncturable layer for removal of the article by the user. Alternatively, the second layer can be torn off, pulled back, peeled off, or bent and torn off for removal. Although this type of packaging is convenient and is in widespread use, unless this type of packaging is modified to be child proof, the products inside the blister pack are easily accessed by children.

One solution to this problem which has been proposed is to provide a blister pack having several layers of material over the transparent or translucent blister side of the package. The use of several layers of material strengthens the rupturable side of the blister card, making it very difficult or impossible to rupture by merely applying force on the article to force it through the layers of material. Instead, one or more layers must be peeled from the blister portion of the pack leaving a single rupturable layer of material over the blister compartment to be accessed. This single layer is then rupturable by force applied through the blister on the article to be removed. While this provides sufficient protection of the article to prevent access by young children, it often poses a problem for adults lacking the required manual dexterity to remove the separable layers and open the desired blister compartment.

Another known device provides a cover arrangement which is slidably disposed over a tray which contains a blister pack. A resiliently mounted button protrudes through an aperture in the cover and must be pressed downwardly to a position inside the cover at the same time as the user applies force on the tray in order to slide the tray outwardly from the cover and access the blister package. However, this can prove difficult for adult individuals lacking good manual dexterity.

BRIEF SUMMARY OF THE INVENTION

Briefly stated, the present invention provides a child-resistant blister package having a tray adapted to receive a blister card having at least one blister compartment. The tray includes a first slide component. A cover having a top and a second slide component is provided. The second slide component is complementary to and slidingly engaged with the first slide component. The second slide component is connected to the top such that the cover can be slidably displaced relative to the tray between a first position, in which the top of the cover substantially overlies the tray and is adapted to prevent access to the blister card, and a second position, in which the cover is displaced at least partially from the tray such that the blister card is exposed. A tab is connected to the cover, and one of a locking projection and a slot is located on the tab. The other of the locking projection and the slot is located on a first portion of the tray in a complementary location to the one of the locking projection and the slot when the cover is in the first position, such that the locking projection is engaged in the slot to limit relative movement of the cover with respect to the tray. One of the tab and the first portion of the tray is movable to a position in which the locking projection is disengaged from the slot to permit movement of the cover to the second position.

BRIEF DESCRIPTION OF THE SEVERAL VIEWS OF THE DRAWINGS

The foregoing summary, as well as the following detailed description of preferred embodiment of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
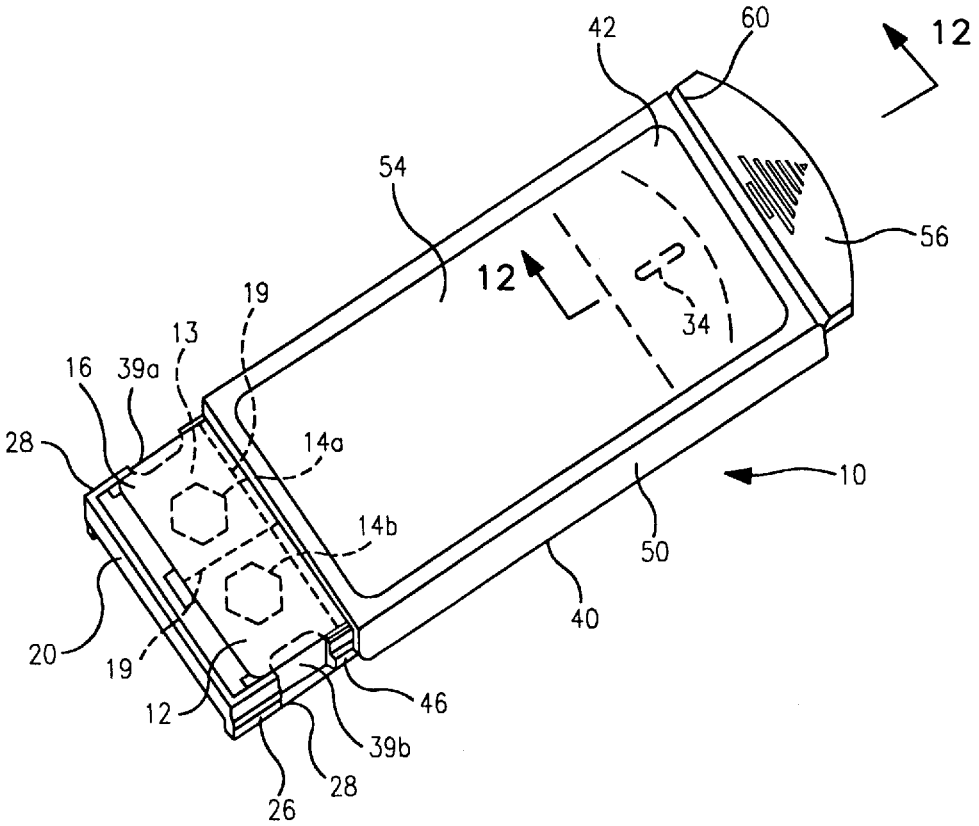
FIG.1 is a perspective view of a child-resistant blister package in accordance with the present invention.

Certain terminology is used in the following description for convenience only and is not limiting. The words "right,"

"left," "lower" and "upper" designate directions in the drawings to which reference is made. The words "inwardly" and "outwardly" refer to directions toward and away from, respectively, the geometric center of the child-resistant blister package 10, and designated parts thereof. The terminology includes the words specifically mentioned above, derivatives thereof and words of similar import.

Figure 2:
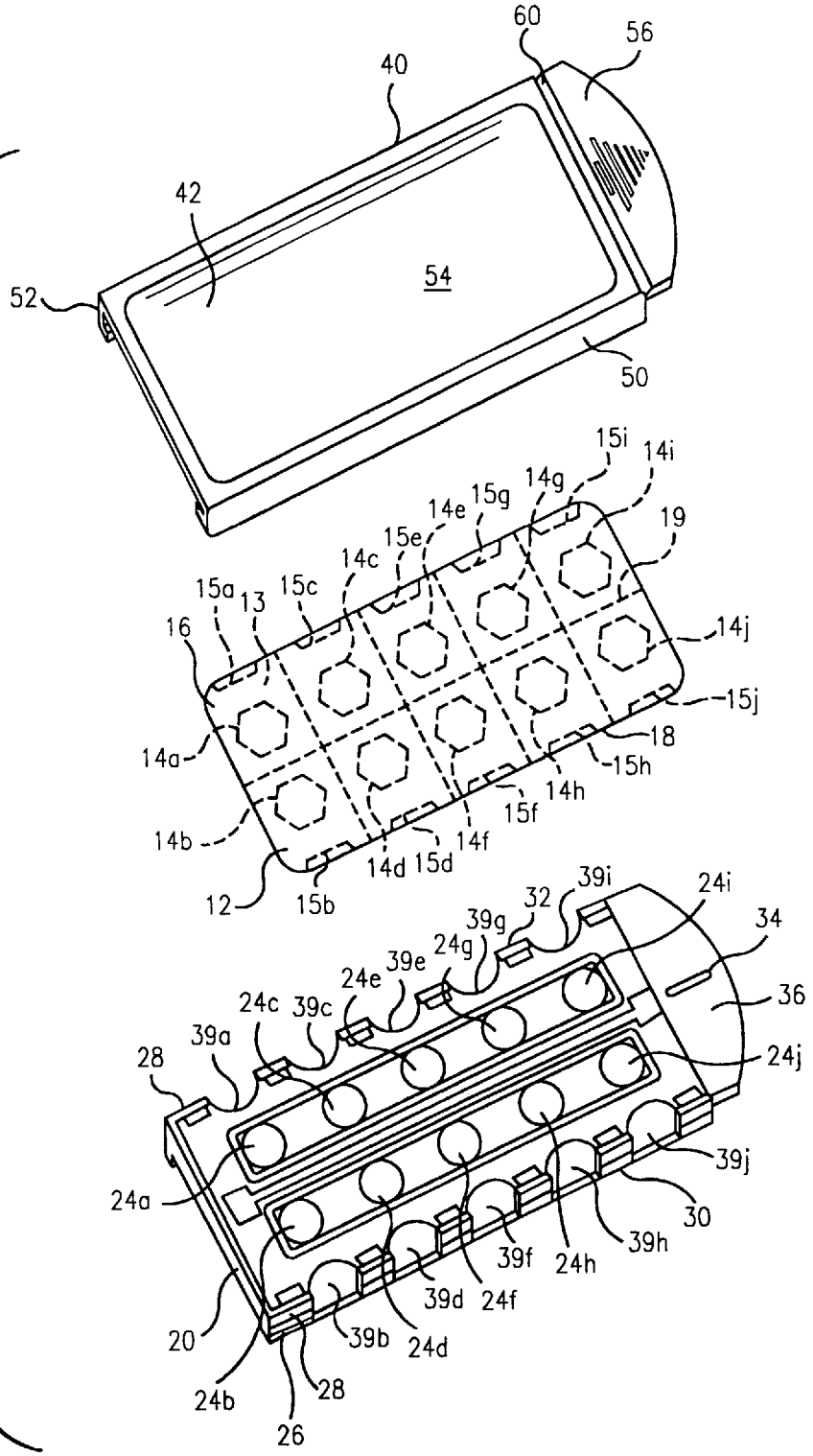
FIG. 2 is an exploded perspective view showing a tray, a cover and a blister card of the child-resistant blister package in accordance with the present invention.

Referring now to FIGS. 1 and 2, there is shown a first preferred embodiment of a child-resistant blister package 10 which is adapted to hold a blister card 12 in a child-resistant manner while still providing easy access for adult users having limited dexterity.

As shown in FIGS. 1–2, the child-resistant blister package 10 comprises a tray 20 which is adapted to receive the blister card 12. Preferably, the blister card 12 has a support surface 13 with at least one blister compartment 14*a*–14*j*, and more preferably, a plurality of blister compartments 14*a*–14*j*. In the first preferred embodiment, a sealing layer 16 is provided which seals the blister compartments 14*a*–14*j*. However, the sealing layer can be omitted in certain applications, such as a blister package 10 which is used for one-time access.

As shown in FIGS. 2, 3, 4 and 6, the tray 20 preferably includes at least one aperture 24*a*–24*j*, and preferably includes a plurality of apertures 24*a*–24*j*, which are located in complementary positions to the at least one blister compartment 14*a*–14*j*. However, it will be recognized by those skilled in the art from the present disclosure that the apertures 24*a*–24*j* can be omitted depending upon the contents and configuration of the blister card 12 if access to the outside of the blister compartment is not required to remove the one or more articles held in the blister card 12.

Figure 3:
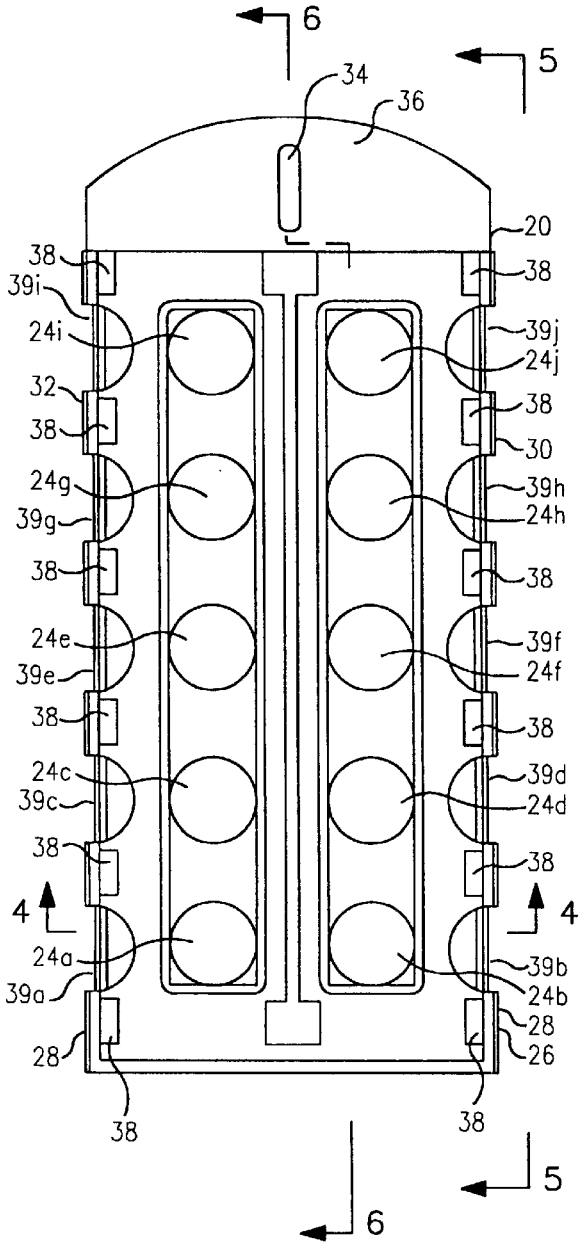
FIG. 3 is a plan view of the tray shown in FIG. 2 for the child-resistant blister package of the present invention.
Figure 5:
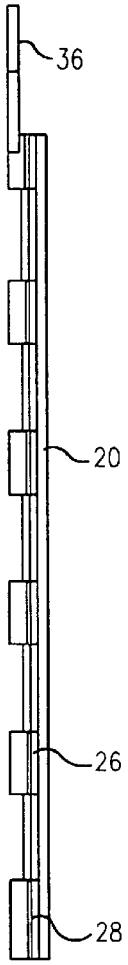
FIG. 5 is a side view taken along lines 5—5 in FIG. 3.
Figure 4:
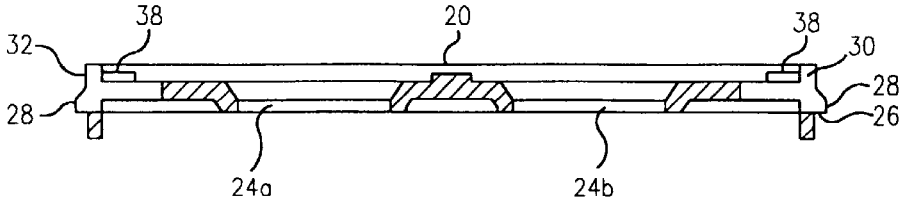
FIG. 4 is an enlarged cross-sectional view taken along lines 4—4 in FIG. 3.

Referring now to FIGS. 2–5, the tray 20 also includes a first slide component 26. Preferably, the tray 20 includes two opposing longitudinal sides 30, 32 and the first slide component 26 comprises a rib 28, shown in detail in FIG. 4, located along at least one of the two longitudinal sides 30, 32. More preferably, a rib 28 is provided along each longitudinal side 30, 32, as shown in FIG. 4.

Figure 7:
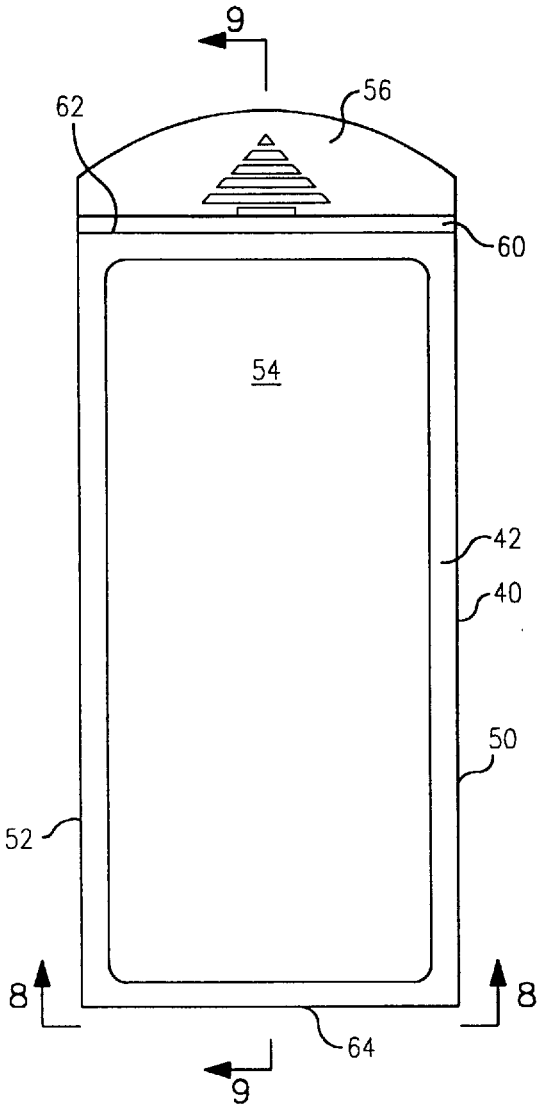
FIG. 7 is a plan view of the cover for the child-resistant blister package in accordance with the present invention.
Figure 8:
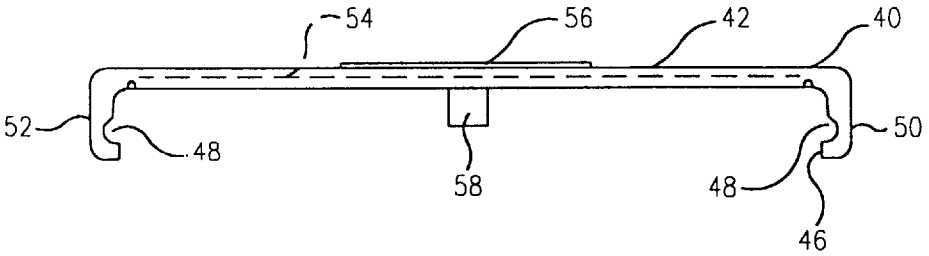
FIG. 8 is an enlarged end view taken along lines 8—8 in FIG. 7.

Referring now to FIGS. 1, 2 and 7–9, a cover 40 having a top 42 is provided. As shown in FIG. 8, a second slide component 46 is located on the cover 40. The second slide component 46 is complementary to and slidably engaged with the first slide component 26 on the tray 20, as shown in FIG. 1, such that the cover 40 can be slidably displaced relative to the tray 20 between a first position, in which the top 42 of the cover 40 substantially overlies the tray 20 and is adapted to prevent access to the blister card 12, and a second position, as shown in FIG. 1, in which the cover 40 is displaced at least partially from the tray 20 such that the blister card 12 is exposed.

In the preferred embodiment, the cover 40 includes two opposing longitudinal side walls 50, 52 which depend from the top 42, as shown in FIG. 8. The second slide component 46 preferably comprises a channel 48 located on at least a corresponding one of the two depending side walls 50, 52 to the rib 28. The channel 48 is preferably complementary to and slidably engaged by the rib 28. Preferably, a channel 48 is provided along each of the longitudinal side walls 50, 52, and ribs 28 are provided along each of the longitudinal sides 30, 32 of the tray 20, with the ribs 28 being slidably engaged in the channels 48 along both longitudinal side walls 50, 52 to provide a slidable connection between the tray 20 and the cover 40.

It will be recognized by those skilled in the art from the present disclosure that any type of slide connection can be used, such as a single longitudinal recess located in one of the tray 20 and the cover 40 and a complementarily shaped projection located on the other of the tray 20 and the cover 40 to provide a sliding connection. For example, a dovetail shaped recess could be provided on one of the tray 20 and the cover 40, and a corresponding dovetail-shaped receiving channel could be provided on the other of the tray 20 and the cover 40 which are interconnected to form a slidable connection.

Still with reference to FIGS. 1, 2 and 7–9, the cover 40 preferably includes a recessed area 54 on the top 42. The recessed area is adapted to receive a label (not shown) which may include product marking and/or information regarding the contents of the blister pack 12. Alternatively, the top 42 can be provided without a recess and product information can be printed or embossed directly on the top 42.

A tab 56 is connected to the cover 40. As shown in detail in FIG. 9, a locking projection 58 is located on the tab 56. However, the tab 56 could include a slot in place of the locking projection 58, if desired. The tab 56 is preferably connected to the cover 40 via an integral hinge 60 which allows the tab 56 to be flexed relative to the top 42 of the cover 40. Preferably, the integral hinge 60 is formed with the cover 40 and the tab 56. More preferably, based on the shape of the integral hinge 60 and the material used to form the cover 40, the tab 56 and the hinge 60, the tab 56' elastically returns to the position shown in FIG. 9 after being flexed upwardly to a second position 56 shown in phantom lines. However, it will be recognized by those skilled in the art that the tab 56 could be a fixed extension of the cover 40, and the corresponding structure on the tray 20 could be movably mounted, as described in detail below.

Figure 12:
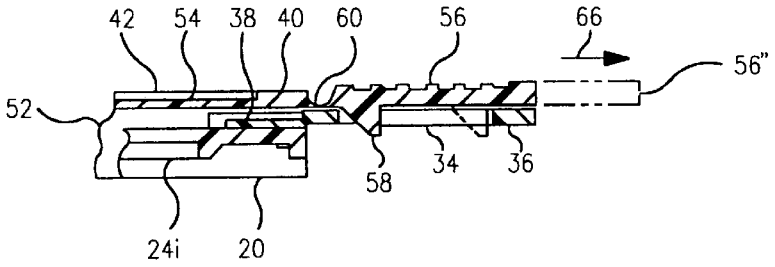
FIG. 12 is a partial cross-sectional view taken along lines 12—12 in FIG. 1 of the child-resistant blister package shown in a first, closed position.
Figure 13:
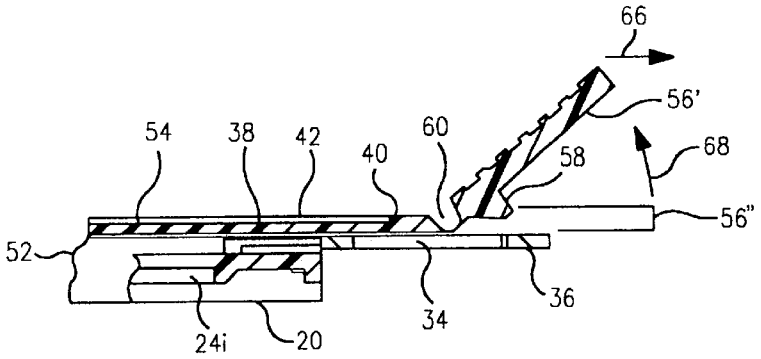
FIG. 13 is a partial cross-sectional view of the child-resistant blister package similar to FIG. 12 which illustrates the opening movement of the blister package to the second, open position.

Referring to FIGS. 1–3, 6, 12 and 13, preferably a slot 34 is located on a first portion of the tray 20 in a complementary location to the locking projection 58 when the cover 40 is in the first, closed position, as shown in FIG. 12, such that the locking projection 58 is engaged in the slot 34 to limit relative movement of the cover 40 with respect to the tray 20. Preferably, the tab 56 is movable to a second position 56' in which the locking projection 58 is disengaged from the slot 34, as shown in FIG. 13, to permit movement of the cover 42 to a second, open position by sliding the cover 40 relative to the tray 20. However, the first portion of the tray 20 could be provided with a locking projection (not shown) and the tab 56 could be provided with the slot (not shown), if desired, depending upon the particular package configuration. Additionally, the first portion of the tray 20 could be movably connected to the tray 20 in the event that the tab 56 is provided as a rigid extension of the cover 40.

As shown in detail in FIGS. 3 and 12, the slot 34 is longer than the locking projection 58 in a direction of sliding movement of the cover 40, indicated by arrow 66 in FIGS. 12 and 13, such that the cover 40 can be slid from the first, closed position, illustrated in FIG. 12, to a tab access position, indicated by phantom lines 56" in FIGS. 12 and 13, where the tab 56 extends outwardly beyond the tray 20. This places the tab 56 in a position which is readily accessible and easily graspable, even by adults with limited dexterity, in order to move the cover 40 to a position where the locking projection 58 is disengaged from the slot 34, as shown in detail in FIG. 13. The cover 40 can then be slid to the second, open position, shown in FIG. 1.

Preferably, the first portion of the tray 20 comprises an extension 36 which is parallel to and offset from the tab 56 when the cover 40 is in the first position. In the first preferred embodiment, the extension 36 is rigidly connected to the tray 20. The locking projection receiving slot 34 is preferably located in the extension 36.

Figure 9:
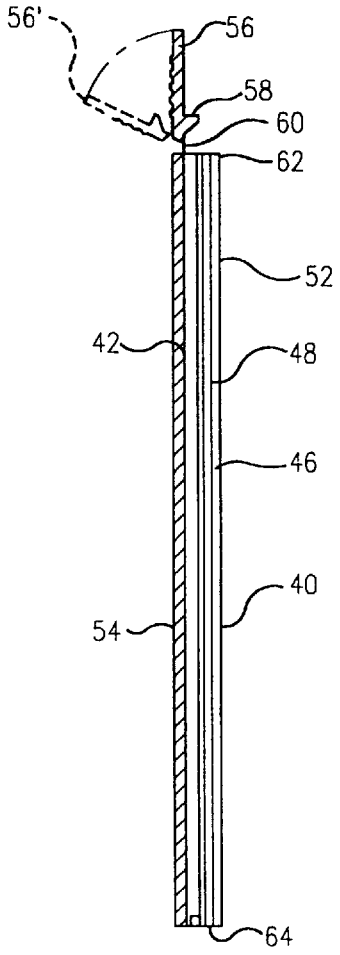
FIG. 9 is a cross-sectional view taken along lines 9—9 in FIG. 7.

As shown in detail in FIGS. 7 and 9, preferably the top 42 of the cover 40 is generally planar and includes two longitudinal ends 62, 64 which are located between the two opposing longitudinal side walls 50, 52. The tab 56 is connected to the cover 40 by the integral hinge 60 which extends outwardly from one of the two longitudinal ends 62, 64 of the top 42, in generally the same plane as the top 42. The hinge 60 is oriented approximately normal to a direction of sliding movement of the cover 40 relative to the tray 20. However, it will be recognized by those skilled in the art from the present disclosure that the tab 56 with the locking projection 58 and the slot 34 in the tray 20 could be located in any position, and the hinge need not be normal to the direction of sliding movement of the cover 40 relative to the tray 20. However, it will be recognized by those skilled in the art that a hinge could be used to connect the extension 36 to the tray 20, and the tab 56 could be a fixed extension of the cover 40.

In the preferred embodiment, the tray 20 and the cover 40 are molded from a plastic material which can be clear or opaque. However, it will be recognized by those skilled in the art from the present disclosure that the tray 20 and the cover 40 can be made from any other suitable material.

Referring to FIGS. 1, 2, 10 and 11, the blister card 12 includes a plurality of blister compartments 14*a*–14*j*. Preferably, a sealing layer 16 is provided which seals the blister compartments 14*a*–14*j*. The blister card 12 is preferably attached to the tray with the blister compartments 14*a*–14*j* being aligned with the complementarily positioned apertures 24*a*–24*j* in the tray 20. The blister card 12 is preferably attached to the tray using an adhesive, ultrasonic bonding, or heat swaging of tabs on the tray. However, it will be recognized by those skilled in the art from the present disclosure that the blister card 12 could be placed in the tray loosely.

Figure 6:
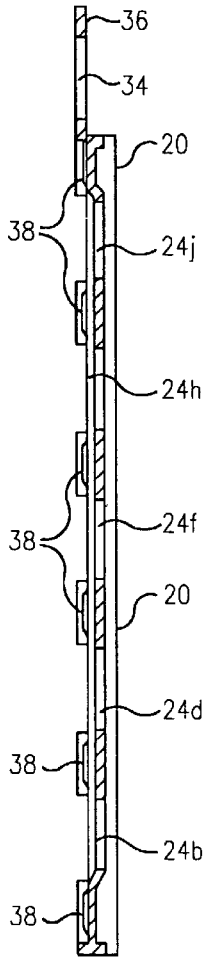
FIG. 6 is a cross-sectional view taken along lines 6—6 in FIG. 3.

As shown in detail in FIGS. 3, 4 and 6, in order to reduce the surface area for the adhesive connection between the blister card 12 and the tray 20, preferably a plurality of raised attachment surfaces 38 are located in the tray 20. The blister card 12 is attached to the tray 20 at the attachment surfaces 38 by the adhesive, ultrasonic bonding or heat swaging. However, it will be recognized by those skilled in the art from the present disclosure that the blister card 12 may be attached to the tray 20 by any suitable means, such as raised pins (not shown) which protrude from the tray 20 and pass through holes in the blister card 12 and are then swaged over. Alternatively, the blister card 12 may be formed integrally with the tray 20.

Figure 10:
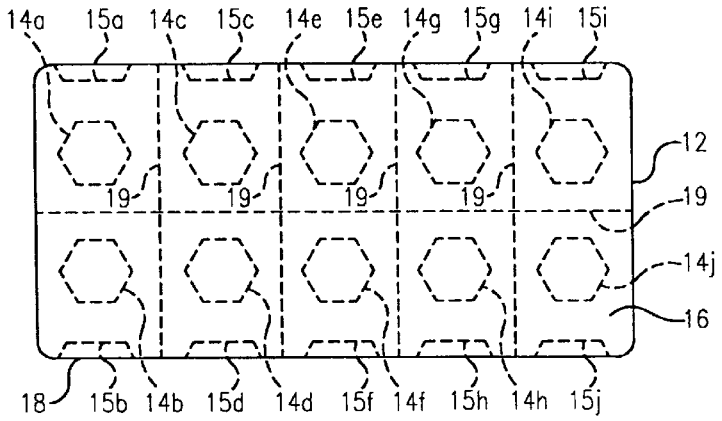
FIG. 10 is a top plan view of a blister card for the child resistant package of the present invention.
Figure 11:
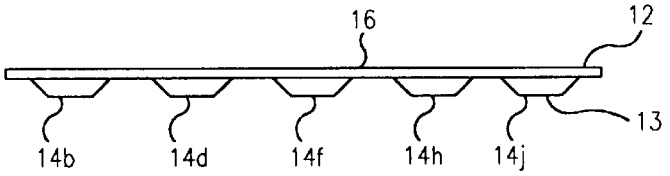
FIG. 11 is a front elevational view of the blister card shown in FIG. 10.

As shown in detail in FIGS. 2, 10 and 11, blister card 12 preferably includes at least one longitudinal edge 18, and at least one of the blister compartments 14*a*–14*j* is positioned adjacent to the at least one longitudinal edge 18. The support surface 13 of the blister card 12 is scalloped under the sealing layer 16 adjacent to the longitudinal edge 18, forming a plurality of finger grip scallops 15*a*–15*j*. Preferably, the sealing layer 16 is divided into segments, as indicated by dashed lines 19 in FIGS. 1,2 and 10, such that an individual segment is associated with each blister compartment 14*a*–14*j*.

Referring again to FIGS. 1–3, the tray 20 preferably includes a finger access opening 39*a*–39*j* adjacent to each blister compartment receiving aperture 24*a*–24*j*. The finger access openings 39*a*–39*j* are adapted to permit access to the finger-grip scallops 15*a*–15*j* on the blister card 12 in order to remove a divided portion of the sealing layer 16 associated with a selected blister compartment 14*a*–14*j*.

The finger-grip access openings 39*a*–39*j* adjacent to each blister compartment receiving aperture 24*a*–24*j* are preferably located along the longitudinal sides 30, 32 of the tray 20 and divide the ribs 28 into a plurality of segments, reducing the contact area of each of the ribs 28 with the respective channels 48 of the cover 40. This results in easier access to each of the blister compartments 14*a*–14*j*.

Referring to FIGS. 12 and 13, in order to access a selected blister compartment 14*a*–14*j*, a user slides the cover 40 relative to the tray 20 in the direction indicated by arrow 66 in FIG. 12 such that the tab 56 projects beyond the extension 36 of the tray 20. The user then flexes the tab 56 upwardly, as indicated by the arrow 68 in FIG. 13. The user then continues to slide the cover 40 relative to the tray 20 such that the cover 40 is displaced at least partially from the tray 20 and the sealing layer 16 of the blister card 12 is at least partially exposed. The user then inserts a finger into the finger access opening 39*a*–39*j* adjacent to the selected blister compartment 14*a*–14*j* and under the segmented portion of the sealing layer 16 in the area of the associated finger-grip scallop 15*a*–15*j* on the blister card 12. By applying upward pressure on the sealing layer 16 adjacent to the selected blister compartment 14*a*–14*j*, the segmented portion of the sealing layer 16 associated with the selected blister compartment 14*a*–14*j* is removed, with the remainder of the sealing layer 16 remaining undisturbed. The article to be removed from the selected blister compartment can then be removed. Removal can be accomplished by lifting out the article, depending upon the size of the article and the blister compartment, by inverting the blister package 10, or by pressing upwardly on the bottom of the selected blister compartment 14*a*–14*j*, which is exposed through the aperture 24*a*–24*j* in the tray 20, if necessary, to dislodge the article from the selected blister compartment 14*a*–14*j*.

Alternatively, if the blister card 12 is unattached, segments can be removed and the card indexed forward such that the next blisters to be removed rest in the vacated space adjacent to the opening.

The child-resistant blister package 10 in accordance with the present invention can be used with a blister card 12 for holding a single article or several articles in a child-proof manner, which is still easy for individuals having limited dexterity to open.

Figure 14:
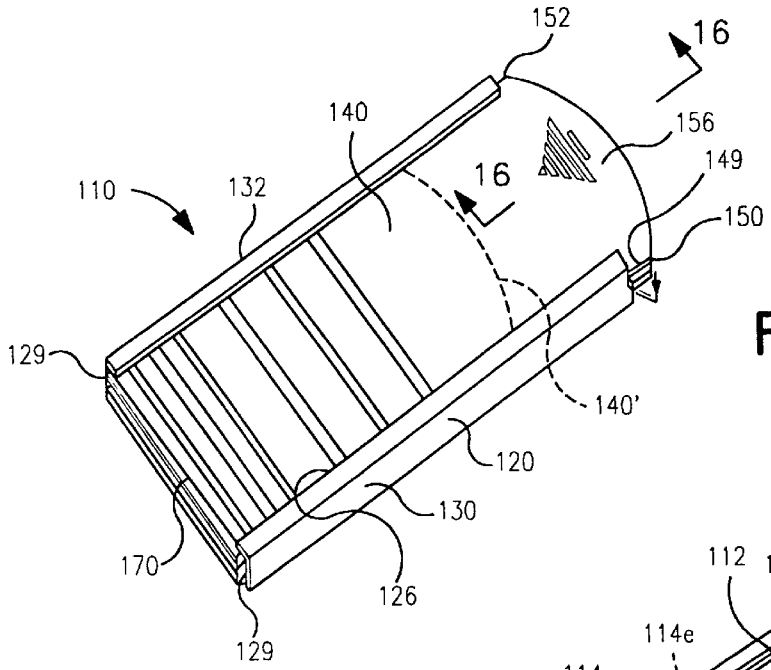
FIG. 14 is a perspective view of a second embodiment of a child-resistant blister package in accordance with the present invention.
Figure 15:
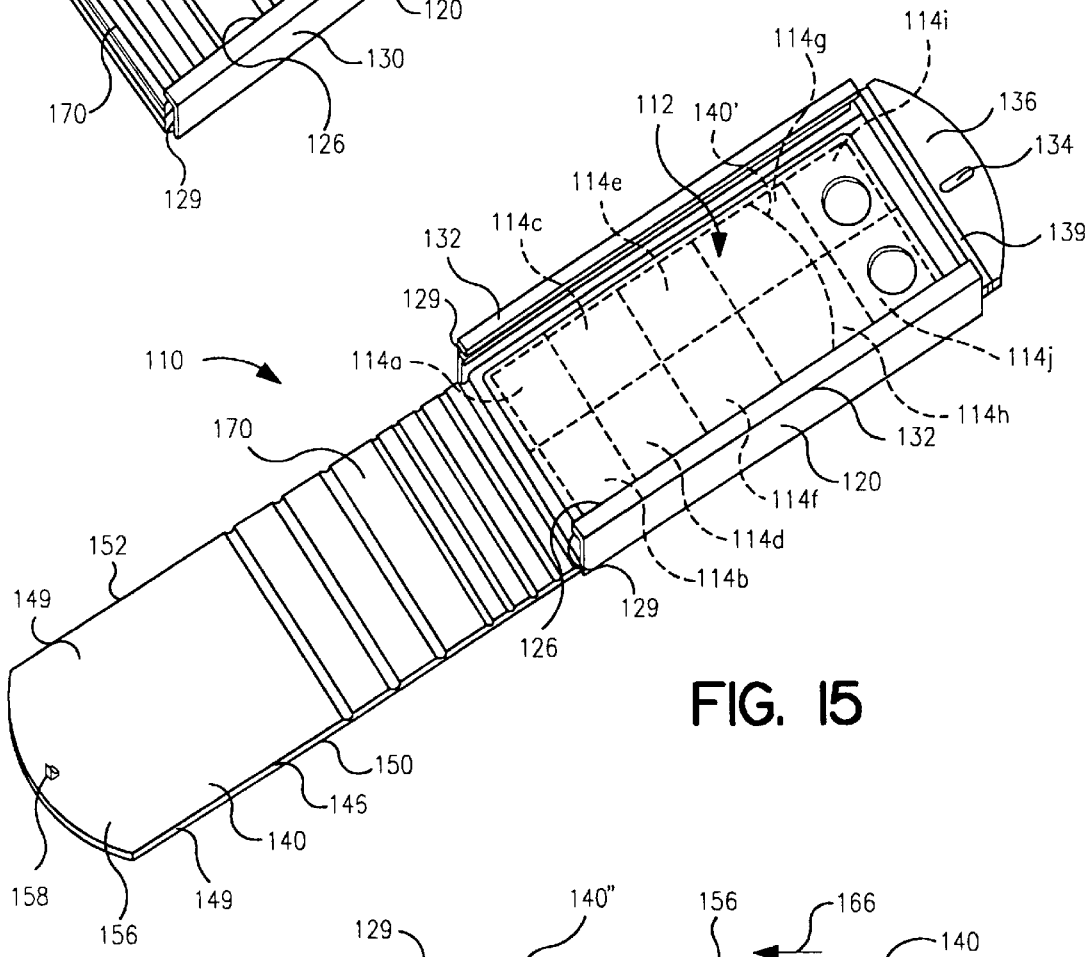
FIG. 15 is a perspective view of the second embodiment of the child-resistant blister package in accordance with the present invention shown partially disassembled.
Figure 16:
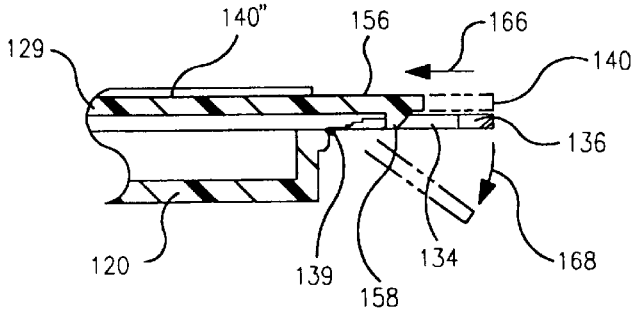
FIG. 16 is a cross-sectional view taken along lines 16—16 in FIG. 14.

Referring now to FIGS. 14–16, a second embodiment of a child-resistant blister package 110 in accordance with the present invention is shown. The second embodiment of the child-resistant blister package 110 is similar to the child-resistant blister package 10 in accordance with the first preferred embodiment, and similar elements have been identified with element numbers with the prefix "1". For example, the tray 20 in the child-resistant blister package 10 in accordance with the first preferred embodiment of the invention is similar to the tray 120 in the child-resistant blister package 110 in accordance with the second embodiment of the invention. Accordingly, it is not believed that a detailed description of the similar elements identified in the drawings is required. A detailed description of the differences between the first and second embodiments 10, 110 of the invention follows.

As shown in FIGS. 14 and 15, the child-resistant blister package 110 includes a tray 120 and a cover 140. The tray 120 is adapted to receive a blister card 112 having a plurality of blister compartments 114*a*–114*j*. Those skilled in the art will recognize that the tray 120 may also include a plurality of apertures (similar to apertures 24*a*–24*j*) to receive the blister compartments 114*a*–114*j*.

The tray 120 preferably includes a first slide component 126. Preferably, the tray 120 includes two longitudinal sides 130, 132, and the first slide component 126 comprises a channel 129 located on at least one of longitudinal sides 130, 132, and preferably on both longitudinal sides 130, 132.

The cover 140 includes a second slide component 146. The second slide component 146 is complementary to and slidably engaged with the first slide component 126 on the cover 120, such that the cover 140 can be slidably displaced relative to the tray 120 between a first position, shown in FIG. 14, in which the cover 140 substantially overlies the tray 120 and is adapted to prevent access to the blister card 112, and a second position, indicated by the dashed line 140' in FIG. 14, where the cover 140 is displaced at least partially from the tray 120 such that the blister card 12 is exposed.

In the second preferred embodiment, the cover 140 includes two opposing longitudinal sides 150, 152. The second slide component 146 preferably comprises an edge portion 149 of at least one of the longitudinal sides 150, 152 which is slidably engaged in the channel 129 on the corresponding longitudinal side 130, 132 of tray 120. Preferably, each of the opposing longitudinal sides 150, 152 of the cover 140 has an edge portion 149 which is engaged in a corresponding channel 129 located on the corresponding longitudinal side 130, 132 of the tray 120.

As noted in connection with the first embodiment of the invention, it will be recognized by those skilled in the art that any type of slidable connection can be provided, and the invention is not limited to the preferred slidable connections described in detail herein.

As shown in FIGS. 14 and 15, the cover 140 is preferably connected to the tray 120 by a multiple hinged portion 170. The multiple hinged portion 170 allows the cover 140 to be slidably displaced relative to the tray 120 by flexing to allow movement of the cover 140. In the second preferred embodiment, the tray 120 and the cover 140 are formed as one piece with the multiple hinged portion 170 from polypropylene. However, it will be understood by those skilled in the art from the present disclosure that any other suitable material, such as a polymeric material, could be used, if desired.

Referring now to FIGS. 15 and 16, the cover 140 preferably includes a tab 156, which is connected to and extends from the free end of the cover 140. A locking projection 158 is located on the tab 156. However, it will be recognized by those skilled in the art from the present disclosure that a slot could be located on the tab 156, if desired.

Still with reference to FIGS. 15 and 16, a first portion of the tray 120 includes a slot 134 which is located in a complementary position to the locking projection 156 on the cover 140 when the cover is in the first position, as shown in FIG. 14. Preferably, the slot 134 is elongated in a direction of sliding movement of the cover 140 relative to the tray 120.

The first portion of the tray 120 preferably comprises an extension 136 which extends parallel and adjacent to the tab 156, and the slot 134 is located in the extension 136. The extension 136 is connected to the tray 120 by a flexible connection 139 to be movable relative to the tray 120 such that the extension 136 can be flexed to a position where the locking projection 156 is disengaged from the slot 134.

It will be recognized by those skilled in the art from the present disclosure that the locking projection could be located on the extension 136 and the slot could be located on the tab 156, if desired.

In use, a user slides the cover 140 in the direction of arrow 166 from the position shown in phantom lines in FIG. 16 to an opening access position, indicated as 140", such that a portion of the extension 136 is exposed and easily accessible, even for a person with limited dexterity. The extension 136 is then flexed away from the tab 156 in the direction of arrow 168 about the hinge 139 in order to disengage the locking projection 158 from the slot 134. The user then continues to slide the cover 140 in the direction of the arrow 166 to the second position where the user can access the blister card 112. In the second preferred embodiment, only two blister compartments **114*i*, 114*j* are exposed. The user tears off the exposed blister compartments 114*i*, 114*j* from the blister card 112, and indexes the blister card 112 forward so that the next dose is accessible. However, it will be recognized by those skilled in the art from the present disclosure that cover 140 may be opened as much as desired, and the blister card 112 may be fixed in the tray 120**, if desired.

It will be appreciated by those skilled in the art that changes could be made to the embodiments described above without departing from the broad inventive concept thereof. It is understood, therefore, that this invention is not limited to the particular embodiments disclosed, and is intended to cover modifications within the spirit and scope of the present invention as defined by the appended claims.

What is claimed is:

1. A child-resistant blister package comprising:

a tray adapted to receive a blister card having an opening and at least one blister compartment, the tray having a first slide component;

a cover having a top and a second slide component which slidably connects the cover to the tray for movement transverse to the opening, the second slide component being complementary to and slidingly engaged with the first slide component for parallel movement relative to one another, the second slide component being connected to the top such that the cover can be slidably displaced relative to the tray between a first position, in which the top of the cover substantially overlies the tray and is adapted to prevent access to the blister card, and a second position, in which the cover is slidably displaced at least partially from the tray such that the blister card is exposed;

a tab connected to the cover, and one of a locking projection and a slot located on the tab; and the other of the locking projection and the slot located on a first portion of the tray in a complementary location to the one of the locking projection and the slot on the tab when the cover is in the first position such that the locking projection is engaged in the slot to limit relative sliding movement of the cover with respect to the tray, one of the tab and the first portion of the tray being slidably movable to a position in which the locking projection can be disengaged from the slot to permit sliding movement of the cover to the second position.

2. The child-resistant blister package of claim 1 wherein the tray includes at least one aperture which is located in a complementary position to the at least one blister compartment to receive the at least one blister compartment.

3. The child-resistant blister package of claim 2 further comprising a blister card having a plurality of blister compartments, the blister card being attached to the tray with the compartments aligned with a plurality of complementarily positioned apertures in the tray.

4. The child-resistant blister package of claim 3 wherein the tray includes attachment surfaces and the blister card is attached to the tray at the attachment surfaces.

5. The child-resistant blister package of claim 3 wherein a sealing layer is located on the blister card and the blister card includes at least one longitudinal edge, at least some of the plurality of blister compartments are positioned adjacent to the at least one longitudinal edge, the blister card is scalloped under the sealing layer adjacent to the longitudinal edge, and the sealing layer is divided into segments such that one segment is associated with each blister compartment.

6. The child-resistant blister package of claim 2 wherein the tray further includes a finger access opening adjacent to the at least one blister compartment receiving aperture and adapted to permit access to a finger-grip scallop on the blister card for removing a portion of the sealing layer associated with a selected one of the at least one blister compartment.

7. The child-resistant blister package of claim 6 further comprising a blister card having a plurality of blister compartments and a sealing layer which seals the blister compartments, the blister card being attached to the tray, the blister card being scalloped under the sealing layer adjacent to each blister compartment in a complementary position to the finger access openings in the tray.

8. The child-resistant blister package of claim 1 wherein the slot is longer than the locking projection in a direction of sliding movement of the cover such that the cover can be slid from the first position to an opening access position where one of the tab and the first portion of the tray extends outwardly from the other of the tab and the first portion of the tray and is readily accessible to be moved to a position where the locking projection is disengaged from the slot and the cover can then be slid toward the second, open position.

9. The child-resistant blister package of claim 1 wherein the tray includes two opposing longitudinal sides and the cover includes two opposing longitudinal side walls which depend from the top, the first slide component comprises a rib located along at least one of the two longitudinal sides, and the second slide component comprises a complementary channel located in at least a corresponding one of the two depending side walls such that the rib is slidably engaged in the channel.

10. The child-resistant blister package of claim 9 wherein a rib is located along each longitudinal side of the tray and a corresponding channel is located in each depending side wall of the cover, the blister compartment including blister receiving apertures which are arranged along the two longitudinal sides, the tray further includes a finger-grip access opening adjacent to each blister compartment receiving aperture which is adapted to permit access to a finger grip scallop on the blister card for removing a divided portion of the sealing layer associated with a selected blister compartment.

11. The child-resistant blister package of claim 10, wherein the finger-grip access openings are located along the longitudinal sides of the tray and divide the ribs into a plurality of segments, reducing the contact area of the ribs in the channels.

12. The child-resistant blister package of claim 9, wherein the top is at least generally planar and includes two longitudinal ends which are located between the two opposing longitudinal side walls, the tab is connected to the cover by an integral hinge and extends outwardly from one of the two longitudinal ends of the top in generally the same plane as the top, the hinge being oriented approximately normal to a direction of sliding movement of the cover relative to the tray.

13. The child-resistant blister package of claim 12 wherein the first portion of the tray comprises an extension which is parallel to and offset from the tab when the cover is in the first position, the locking projection receiving slot being located in the extension.

14. The child-resistant blister package of claim 13, wherein the slot is longer than the locking projection in a direction of sliding movement of the cover such that the cover can be slid from the first position to a tab access position where the tab extends outwardly from the tray extension and is readily accessible to be moved to a position where the locking projection is disengaged from the slot and the cover can then be slid toward the second, open position.

15. The child-resistant blister package of claim 1, wherein the locking projection is located on the tab, the first portion of the tray comprises an extension which includes the slot, and the extension is movable to a position where the locking projection is disengaged from the slot.

16. The child-resistant blister package of claim 15, wherein the tray and the cover are connected together by a multiple hinged portion.

17. The child-resistant blister package of claim 16, wherein the tray, the cover, and the multiple hinged portion are integrally formed.

18. A child-resistant blister package comprising:

a tray having an opening which is adapted to receive a blister card;

a cover slidably engaged with the tray for transverse movement to the opening such that the cover can be slidably displaced in a linear direction from a first position, in which the top of the cover substantially overlies the tray and is adapted to prevent access to the blister card, and a second position, in which the cover is displaced in the linear direction at least partially from the tray such that the blister card in exposed;

a tab connected to the cover, and one of a locking projection and a slot located on the tab; and the other of the locking projection and the slot located on a first portion of the tray in a complementary location to the one of the locking projection and the slot on the tab when the cover is in the first position, the locking projection being engaged in the slot to limit relative movement of the cover with respect to the tray, and one of the tab and the first portion of the tray being movable in the linear direction to an access position from which a user can disengage the locking projection from the slot to permit linear sliding movement of the cover to the second position.

* * * * *